US010625531B1

(12) United States Patent
Peterson

(10) Patent No.: US 10,625,531 B1
(45) Date of Patent: Apr. 21, 2020

(54) GREETING CARDS AND POSTCARDS WITH CONCEALED FEATURE

(71) Applicant: Wolf Punch, LLC, Irvine, CA (US)

(72) Inventor: Travis Walker Peterson, Irvine, CA (US)

(73) Assignee: WOLF PUNCH, LLC, Irvine, CA (US)

( * ) Notice: Subject to any disclaimer, the term of this patent is extended or adjusted under 35 U.S.C. 154(b) by 0 days.

(21) Appl. No.: 15/628,515

(22) Filed: Jun. 20, 2017

Related U.S. Application Data

(60) Provisional application No. 62/352,943, filed on Jun. 21, 2016, provisional application No. 62/466,558, filed on Mar. 3, 2017.

(51) Int. Cl.
*B42D 15/04* (2006.01)
*G09F 1/04* (2006.01)
*B42D 15/02* (2006.01)

(52) U.S. Cl.
CPC ..... *B42D 15/045* (2013.01); *B42D 15/022* (2013.01); *G09F 1/04* (2013.01)

(58) Field of Classification Search
USPC ..... 40/124.06
See application file for complete search history.

(56) References Cited

U.S. PATENT DOCUMENTS 4,787,160 A * 11/1988 Balsamo ..... B42D 15/045 206/469
4,979,171 A * 12/1990 Ashley ..... H04Q 1/4575 370/525
5,199,745 A * 4/1993 Balsamo ..... G09F 1/04 206/469
7,322,134 B2 * 1/2008 Cheek ..... B65D 33/00 40/124.06
9,592,933 B1 * 3/2017 Campbell ..... B65D 33/004
2011/0247247 A1 * 10/2011 Mayer ..... B42D 15/022 40/124.03

(Continued)

OTHER PUBLICATIONS

Red River Paper, 881b Polar Matter Magna Card Stock, Aug. 30, 2014, pp. 1-5, https://web.archive.org/web/20140830170121/http://www.redrivercatalog.com/browse/96lb-polar-matte-magnum-photo-inkjet-card-stock-paper.htnnl (Year: 2014).*

(Continued)

*Primary Examiner* — Kristina N Junge
(74) *Attorney, Agent, or Firm* — Knobbe, Martens, Olson & Bear, LLP

(57) ABSTRACT

Some embodiments provide a greeting card or a postcard with a concealed feature, such as, for example, a practical joke feature. The concealed feature can include concealed hardware that repeatedly plays a sound for several hours, days, or weeks. The concealed feature can include a concealed keeper element or pouch that contains a payload, such as, for example, confetti, glitter, stickers, or toys. The card can include a mode of operation configured to allow a card-giver to inspect and/or write on the interior of the card without activating a concealed feature. The card can be configured to release the contents of the keeper element or pouch when a recipient attempts to open or destroy the card. The card can include one or more features that resist destruction of the card and/or internal components of the card that implement a concealed feature or a practical joke feature.

21 Claims, 9 Drawing Sheets

(56) References Cited

U.S. PATENT DOCUMENTS

2013/0263481 A1* 10/2013 Nwosu ..... B42D 15/02
40/124.06
2013/0283651 A1* 10/2013 Marsh ..... B42D 15/0093
40/124.03

OTHER PUBLICATIONS https://web.archive.org/web/20160406012917/http://www.thimblepress.com/product/thanks-confetti-card/ saved by Archive.org on Apr. 6, 2016.
https://web.archive.org/web/20160406042952/http://www.thimblepress.com/product/ratte-and-roll-confetti-card/ saved by Archive.org on Apr. 6, 2016.
https://web.archive.org/web/20160617203008/https:/www.thimblepress.com/shop/product-category/party-goods/confetti-card/ saved by Archive.org Jun. 17, 2016.
https://web.archive.org/web/20160405181418/http://www.thimblepress.com/product/happy-birthday-confetti-card/ saved by Archive.org on Apr. 5, 2016.
https://web.archive.org/web/20160316021605/http://www.thimblepress.com/product/love-confetti-card/ saved by Archive.org on Mar. 16, 2016.
https://web.archive.org/web/20160617203008/https://www.thimblepress.com/shop/product-category/party-goods/confetti-cards/ saved by Archive.org on Jun. 17, 2016.
https://web.archive.org/web/20160318034621/http://www.thimblepress.com/product/celebration-confetti-card saved by Archive.org on Mar. 18, 2016.

* cited by examiner

GREETING CARDS AND POSTCARDS WITH CONCEALED FEATURE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims the benefit under 35 U.S.C. 119(e) of U.S. Provisional Patent Application No. 62/352,943, filed Jun. 21, 2016, and U.S. Provisional Patent Application No. 62/466,558, filed Mar. 3, 2017. The entire contents of the patent applications referenced in this paragraph are incorporated by reference and made a part of this disclosure.

BACKGROUND

Technical Field

This disclosure is directed to greeting cards, postcards, and other products with printed messages or indicia.

Description of Related Art

Greeting cards and postcards can take the form of a folded piece of paper, heavy paper stock, cardboard, or another medium capable of being printed upon. Greeting cards typically can be inserted into an envelope and mailed. A greeting card or postcard can have a theme (e.g., Christmas) and may contain theme associated printed text or messages (e.g., Merry Christmas) and indicia (e.g., a snowman). When included in a greeting card or postcard, such themed indicia and printed information increases the card's whimsical and festive nature by increasing the functionality of the card in certain circumstances.

SUMMARY

A greeting card can be more meaningful or memorable when it includes a concealed feature that surprises a recipient of the greeting card. Examples of a concealed feature include hardware for playing a sound or music when the card is opened, user interface elements (such as, for example, buttons or switches) that operate in unexpected ways, an unobtrusive keeper element that unexpectedly deploys a payload under certain circumstances (such as, for example, when the card is opened or destroyed), a feature that annoys the recipient, or a combination of features.

Some embodiments provide a greeting card that includes a first panel and a second panel having inside surfaces that contact each other when the greeting card is folded. The greeting card can include an adhesive element including an adhesive substance and a protective cover disposed on a first inside surface of the first panel. The protective cover can be removable by a giver of the greeting card in order to expose the adhesive substance. The adhesive substance can be configured to adhere to material connected to a second inside surface of the second panel as a result of the protective cover being removed and the greeting card folded by the giver.

In certain embodiments, the greeting card includes a keeper element. At least a portion of the keeper element can be adhered to the second inside surface of the second panel. The adhesive substance can be configured to adhere to at least a portion of the keeper element when the greeting card is folded and when the protective cover is removed. The keeper element can have features that make it more difficult for the greeting card recipient to detect the keeper element. For example, in some embodiments, the keeper element has perforations that enable it to tear open more easily. These features can increase the feeling of surprise experienced by the recipient when contents of the keeper element are released.

The greeting card can include a payload contained by the keeper element. The payload can be configured to be released from the keeper element as a result of a recipient of the greeting card unfolding the greeting card after the giver has removed the protective cover and folded the greeting card. At least a portion of the adhesive element can be configured to adhere to at least a portion of the keeper element after the protective cover is removed and the greeting card is folded. At least a portion of the adhesive element can be configured to tear open the keeper element when the greeting card is opened by the recipient.

DETAILED DESCRIPTION OF CERTAIN EMBODIMENTS

Example embodiments described herein have several features, no single one of which is indispensable or solely responsible for their desirable attributes. Without limiting the scope of the claims, some of the advantageous features of some embodiments will be described.

Some embodiments provide a greeting card or a postcard with a concealed feature, such as, for example, practical joke feature. The concealed feature can include a sound that is repeatedly played for several hours, days, weeks, etc. The card can include a mode of operation configured to allow a giver of the card to experience the concealed feature without arming the concealed feature. The card can include a pouch that contains one or more surprises for card recipients that attempt to open or destroy the card. The card can include one or more features that resist destruction of the card and/or internal components of the card that implement the concealed feature.

Figure 1:
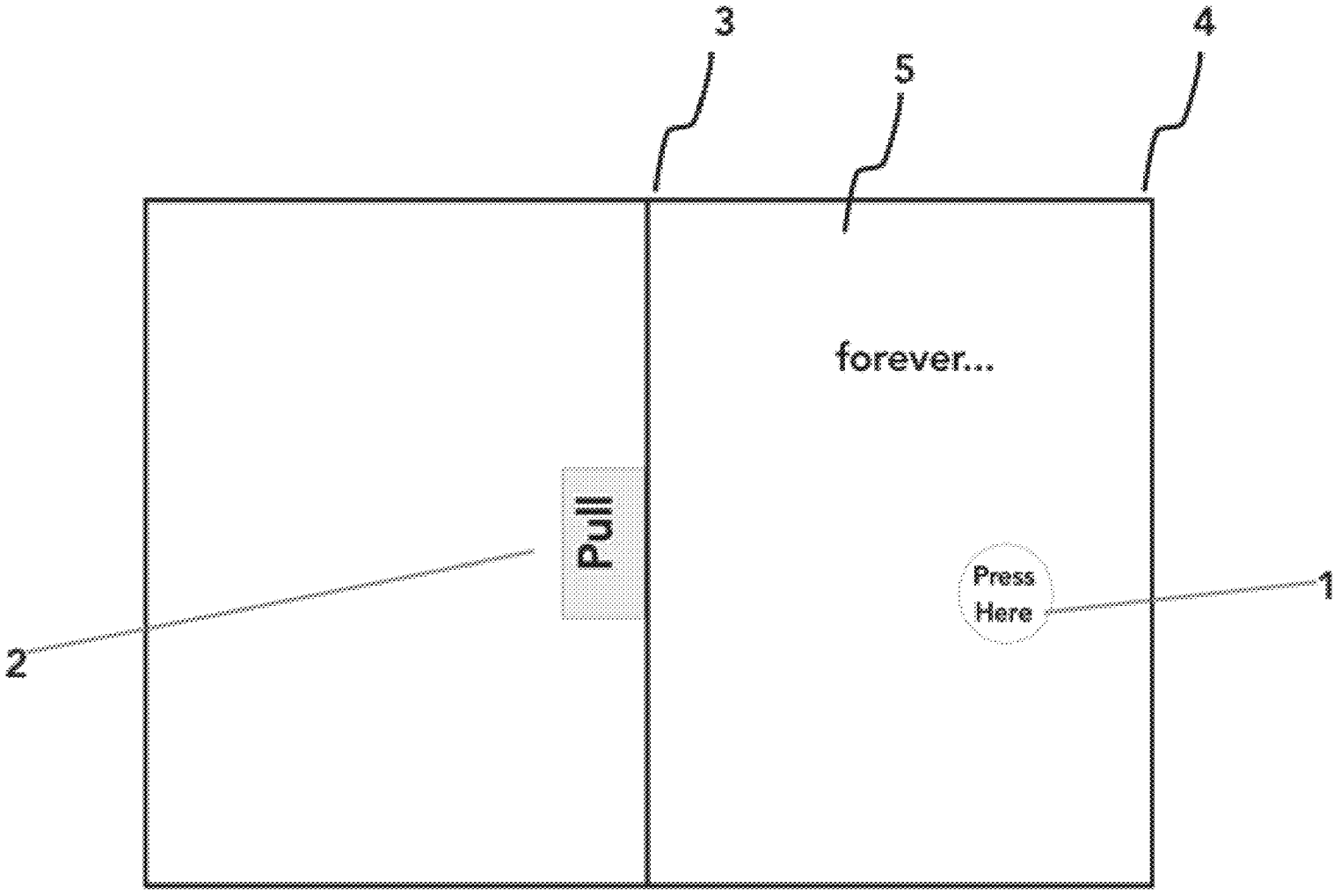
FIG. 1 shows a view of an unfolded greeting card embodiment with a removable tab for activating a practical joke feature.

FIG. 1 is a view of an unfolded greeting card that can have one or more than one practical joke feature. The card can be divided into two or more sections separated by a fold 3. A section of the card can include one or more than one layer of material. For example, a section can include an inside layer 5 of material. When the card is folded, the inside layer 5 is between a front outer layer (not shown) and a back outer layer (not shown), and any themed indicia or information printed on the inside layer 5 are not visible. The card can be made from any suitable materials, including, for example, paper, cardstock, others material used to make greeting cards, or a combination of materials. The inside layer 5 and the outer layer of the card can meet at a seam or fold 4. One or more circuits, transducers (such as, for example, speakers), power sources, or other electronics can be disposed between the inside layer 5 and the outer layer of the card, and can be obscured from view whether the card is folded or unfolded. In some embodiments, the inside layer 5 and the outer layer are fastened together along at least a portion of the outer periphery of the card. The layers can be fastened by any suitable technique, including techniques using adhesive, matched tabs and slots, hook-and-loop fasteners, rivets, other fasteners, or a combination of any two or more fasteners. In the illustrated embodiment, the fold 3 is disposed at or near a midpoint between the outer left periphery and the outer right periphery of the card. One or more layers of the card can be scored or bent at the fold 3.

In the embodiment illustrated in FIG. 1, the card includes a mode of operation switch (such as, for example, a tab 2) configured to change the mode of operation of the card from a state where a pre-recorded sound can be listened to one or more times according to the card-giver's preference to a state where the pre-recorded sound cannot be turned off once the card is opened. The tab 2 can be removed by a given of the card before the card is given or mailed to a recipient. In certain embodiments, the mode of operation switch can only be operated once. In such embodiments, once the mode of operation of the card is changed, the mode of operation switch cannot return the card to its original mode of operation.

In some embodiments, the tab 2 is mechanically attached to a controller that implements at least two modes of card operation. The at least two modes of card operation can include a first mode of operation, or safe mode. In the safe mode, the card is configured to play a sound once or more than once, but for less than 10 minutes, less than 5 minutes, or less than 90 seconds when a user interface element (such as, for example, a button 1) is operated. In some embodiments, the card operates in the safe mode until the tab 2 is removed. The tab 2 can be made of paper or another suitable material that can attach to the controller and be removed by the user. In some embodiments, the tab 2 is perforated and attached to the inside layer 5. The tab 2 can protrude through a slit or opening in the inside layer 5. In some embodiments, while the tab 2 is attached to the card, and whether the card is open or closed, the play button 1 can be pressed, and the controller will play one full loop of a pre-recorded sound. The pre-recorded sound can last 0.0001 seconds-90.00 seconds.

Figure 2:
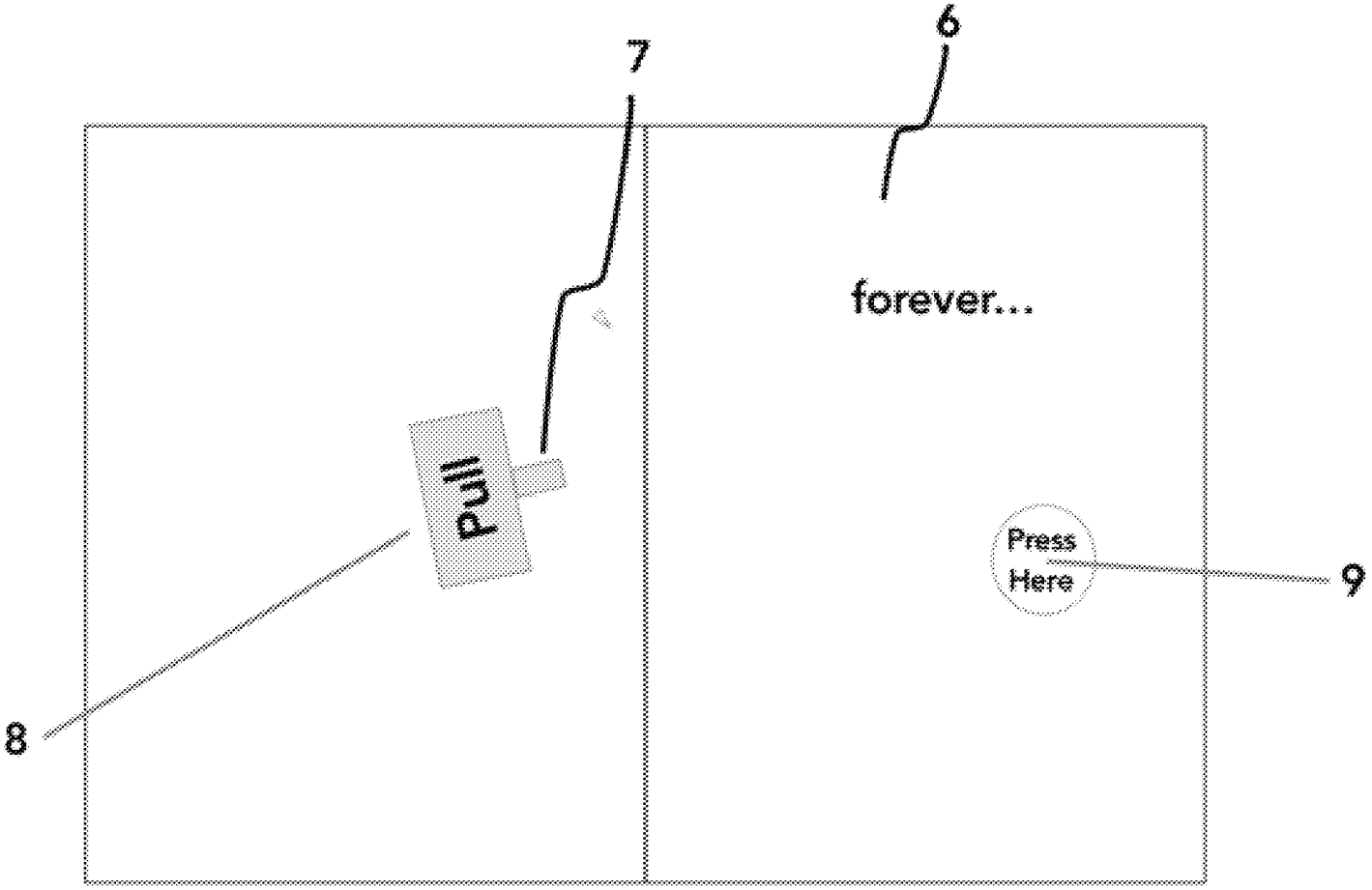
FIG. 2 shows a view of the embodiment of FIG. 1 with the tab removed.

FIG. 2 shows a view of the embodiment of FIG. 1 with the tab 2 (which is numbered as tab 8 in FIG. 2) shown in FIG. 1 removed. The tab 8 is configured to detach from the inside layer 6 (which is numbered as inside layer 5 in FIG. 1) when it is pulled outward. When the tab 8 is detached, the controller is placed in a second mode of operation. This can be accomplished by any suitable technique. For example, the tab 8 can attach to a safety switch (such as, for example, a plastic member 7). The safety switch 7 is configured to keep the card in safe mode before the mode of operation switch is operated. When the safety switch 7 is removed, the card is placed into a second mode of operation (or recipient mode). In the recipient mode, a trigger for a user interface element (such as, for example, the play button 9, which is numbered as button 1 in FIG. 1) is activated, and the card is configured to play a pre-recorded loop of sound until the battery is drained. In some embodiments, the sound is initiated by operating the user interface element after the mode of operation switch is activated. In other embodiments, the sound is initiated by unfolding the card after the mode of operation switch is activated. In certain embodiments, the controller of the card is configured to raise the volume of the sound when the button 9 is pressed one or more times after the sound is initiated.

In some embodiments, the card has a controller configured to play a pre-recorded sound one time when the button is pressed while the card is in safe mode. The controller is configured to play the pre-recorded sound continuously in a loop until the batteries are drained after the sound is initiated while the card is in recipient mode. In some embodiments, the battery is configured to power the card for greater than or equal to about 1 hour, greater than or equal to about 2 hours, greater than or equal to about 3 hours, greater than or equal to about 4 hours, less than or equal to about 10 hours, or for a period of time between any of the preceding values.

Figure 3:
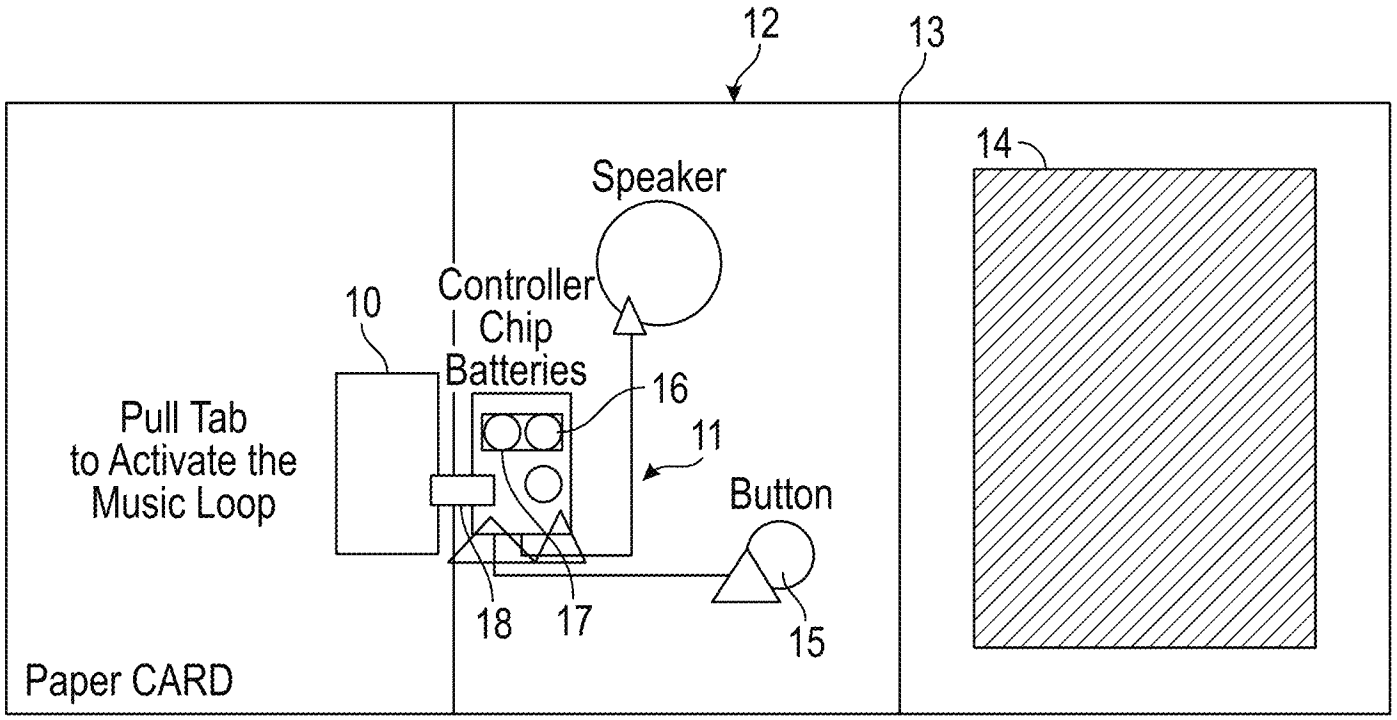
FIG. 3 shows a view of internal components of the embodiment shown in FIG. 1.

FIG. 3 shows a view of internal components of the greeting card embodiment shown in FIG. 1. The card 12 can include internal components positioned between the inner layer 5 and the outer layer of the card. In some embodiments, the components include wires 11, batteries 16, and other components that can fail when exposed to impacts, drops, kicks, and other forces. The card can include features that protect the wires 11, batteries 16, connections, and other sensitive circuit elements. For example, padding can be placed between sensitive circuit elements 11, 15, and 17 and at least one of the card layers so that the card can withstand significant impact forces without component failure.

In certain embodiments, the card is configured to hold a substantial quantity of small particles (such as, for example, glitter or confetti) without permitting the small particles to fall out of the card.

In some embodiments, the card 12 includes a pouch 14 for holding items inside of the card that can be revealed when the card is ripped or otherwise destroyed. The pouch 14 can be attached to the card using any suitable technique. For example, the pouch 14 can be glued to a layer of the card around at least a portion of the periphery of the pouch 14. The pouch 14 can be constructed from any suitable material capable of being ripped by a human of average strength. For example, the pouch 14 can be made of soft tissue paper. In certain embodiments, the pouch 14 is sized to hold a substantial quantity small particles, such as glitter or confetti; small toys; stickers; press-on tattoos; candy; ribbons; paper with printed messages such as fortunes; bubble wrap; other tangible items; or a combination of items. The pouch 14 can be made from paper weighing between 5-50 grams per square meter, paper weighing between 10-20 grams per square meter (g/m^2 or gsm), or another material that breaks easily when the card is opened up or ripped apart. Some embodiments are configured such that the pouch tears apart if the card is opened from the front, opened from the back, or ripped down the middle. The pouch 14 can be concealed such that the pouch 14 cannot be seen by looking at the exterior of the card.

The card can include a power source 16 that is configured to power the electronic components of the card for greater than or equal to about 3 hours, greater than or equal to about 4 hours, less than or equal to about 10 hours, and/or less than or equal to about 24 hours. For example, the power source 16 can include three AG10 batteries or another battery configuration selected such that the thickness of the card when folded is less than or equal to 10 mm, less than or equal to 6 mm, less than or equal to 5 mm, less than or equal to 4 mm, greater than or equal to 3 mm, and/or within a range between any of the preceding values. The card can include a fold line 13 that permits the pouch 14 and the internal components of the card to be hidden from view when the card is folded. One or more fasteners can be used to connect the inner layer of the card to the outer layer of the card when the card is folded at the fold line 13. The card 12 can have any dimensions suitable for a greeting card, such as, for example, 5×7 inches. The card can be made of card stock, paper, another material suitable for printed messages or indicia, or a combination of materials. In some embodiments, the mode of operation switch 10 (which is numbered as tab 8 in FIG. 2 and as tab 2 in FIG. 1) is attached to an electrical insulator 18 separates leads in a circuit that activates the recipient mode when the circuit is closed by removal of the insulator 18.

Figure 4:
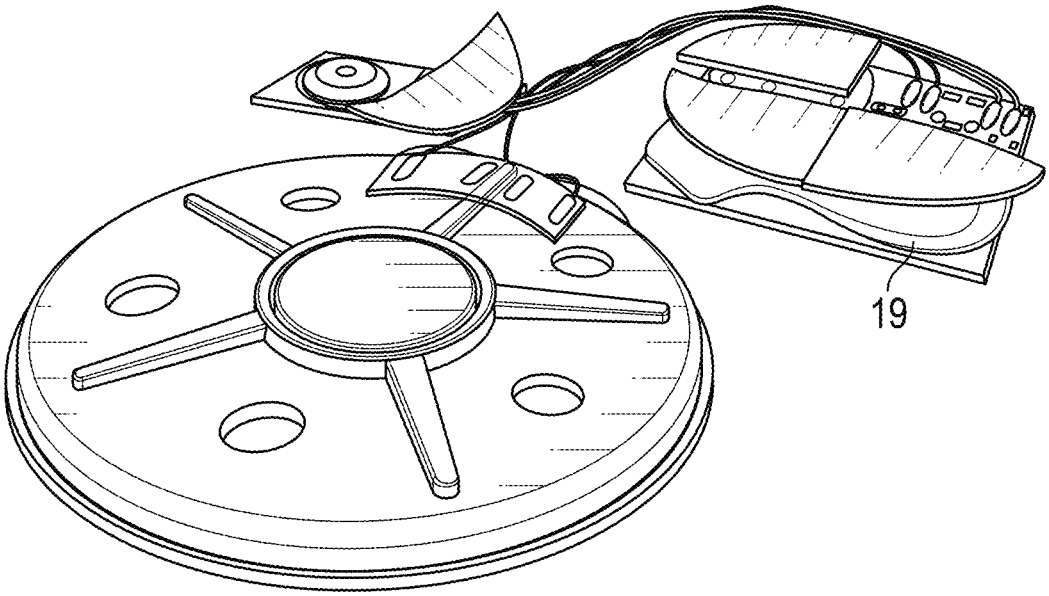
FIG. 4 shows a view of internal components of the embodiment shown in FIG. 1 with features that increase the durability of the internal components.

FIG. 4 shows a view of internal components of the embodiment shown in FIG. 1 with features that increase the durability of at least some of the internal components. In the embodiment shown in FIG. 4, a layer of electrically insulating material 19, such as, for example, adhesive, sealant, or encapsulant, is disposed adjacent to, on top of, or around the power source. For example, the material can encapsulate the electrodes of the power source, encapsulate a substantial portion of the power source, or encapsulate substantially all of the power source. The insulating material can assist in maintaining the power source in contact with electric leads and in a sealed condition. The insulating material can keep the card functioning even after the card is hit, thrown, and/or smashed. The insulating material layer can have a thickness that is slightly greater than the thickness of the power source. For example, the thickness of the insulating material layer can be greater than or equal to 2 mm, greater than or equal to 3 mm, greater than or equal to 4 mm, less than or equal to 5 mm, less than or equal to 6 mm, and/or within a range between any of the preceding values.

Figure 5:
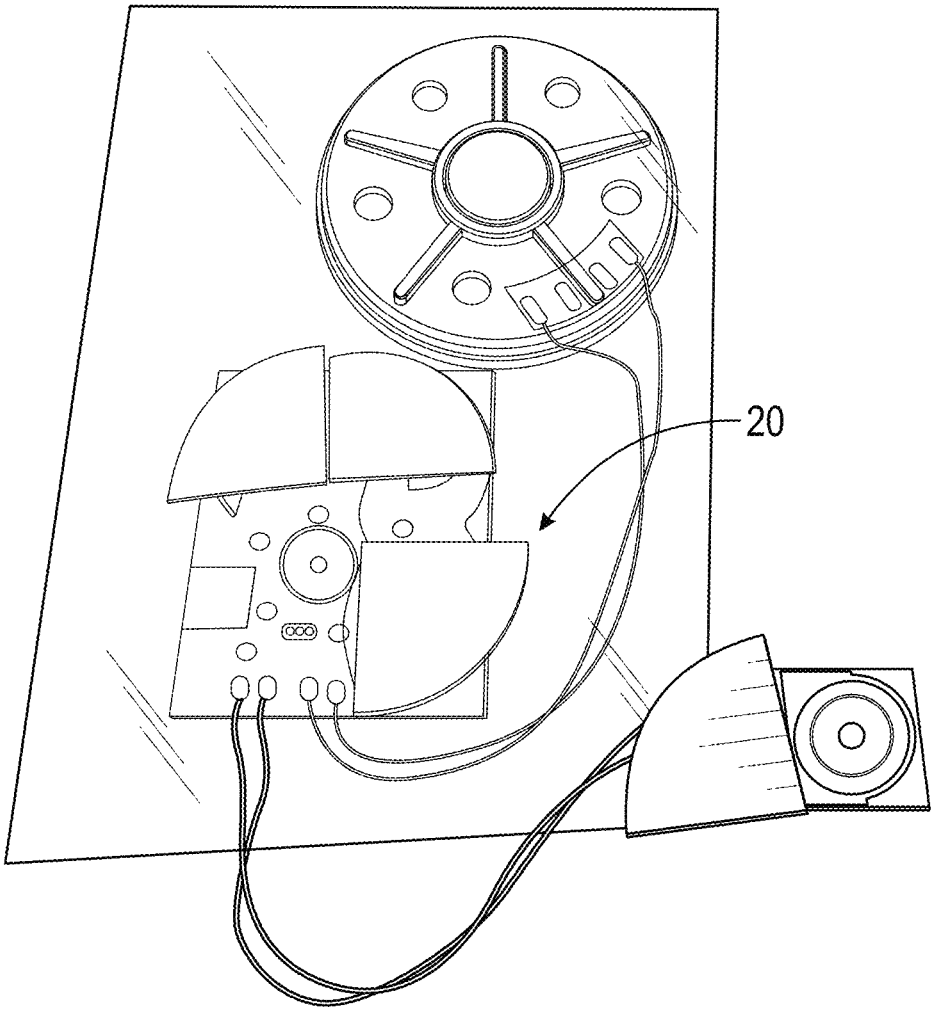
FIG. 5 shows a view of internal components of the embodiment shown in FIG. 1 with features that increase the durability of the internal components.
Figure 6:
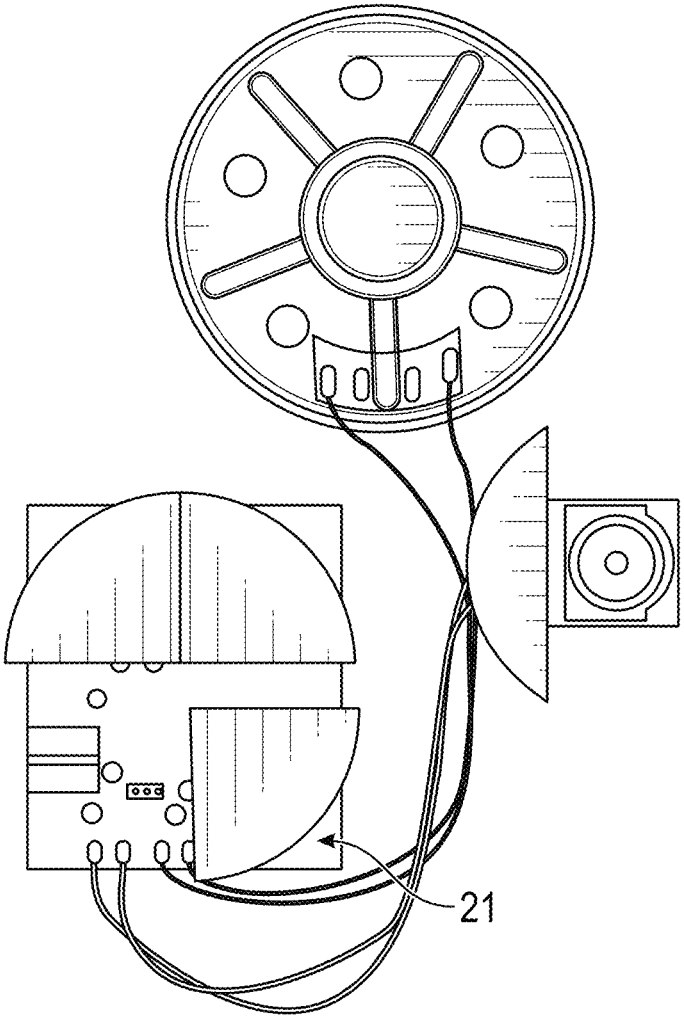
FIG. 6 shows a view of internal components of the embodiment shown in FIG. 1 with features that increase the durability of the internal components.

FIGS. 5 and 6 show views of internal components of the embodiment shown in FIG. 1 with additional features that increase the durability of at least some of the internal components. In some embodiments, padding 21 is disposed between the power source and one or more adjacent layers of the card. In some embodiments, the padding 21 is in a layer that is less than 1 mm thick. The padding 21 can have an area that is greater than the area of the adjacent power source, greater than or equal to 150% of the area of the adjacent power source, and/or less than 200% of the area of the adjacent power source. An electrically insulating material 19 can be disposed between the padding 21 and the power source. The padding 21 can reduce or spread out the force transmitted to the power source during an impact on the card, thus increasing the durability of the card's internal components.

In some embodiments, the padding 21 has top and bottom surfaces that are covered with adhesive and/or adhered to adjoining surfaces above and below the padding 21. The padding 21 can thereby provide structure that resists separation of the inner layer from the outer layer of the card by the user. If the card contains a pouch 14, the padding can adhere to the pouch 14 and rip the pouch 14 open when the inner layer and outer layer of the card are separated from each other.

Insulating material 19 and/or padding 21 can also be disposed between the user interface mechanism (such as, for example, button 15 shown in FIG. 3) and one or more layers of the card.

In certain embodiments, insulating material 19 is applied to all soldering points present in the internal components of the card. Wires connecting to the speaker are soldered. The soldering points on the controller that lead to the speaker can be encapsulated with insulating material 19, such as, for example, adhesive.

In some embodiments, a protective enclosure or layer 20 is disposed around or adjacent to at least the controller and the speaker. The protective enclosure or layer 20 can be constructed from a material that resists tearing, thus making it more difficult for the user to stress or break the wires and connections between the controller and the speaker by tearing the card.

Figure 7:
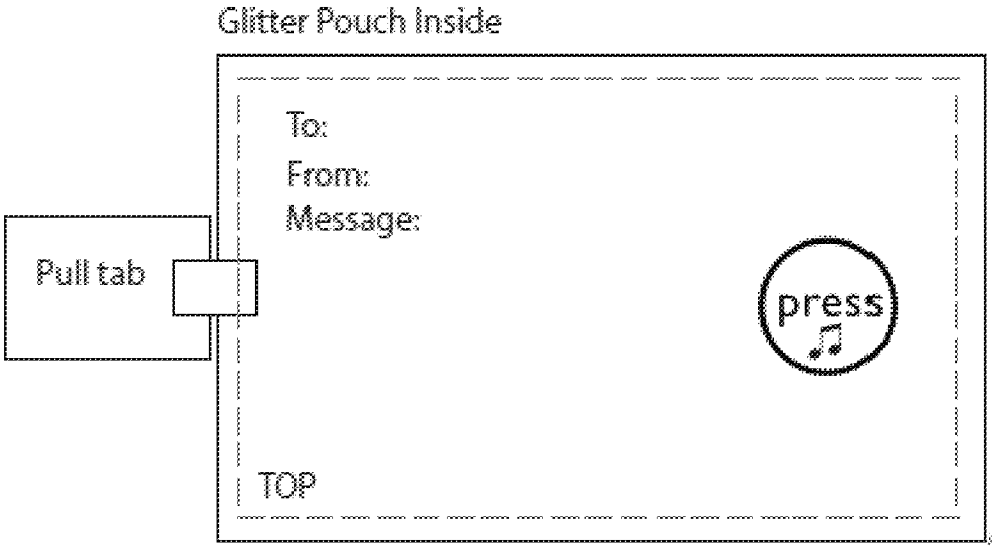
FIG. 7 shows a view of a postcard embodiment with a removable tab for activating a practical joke feature.
Figure 8:
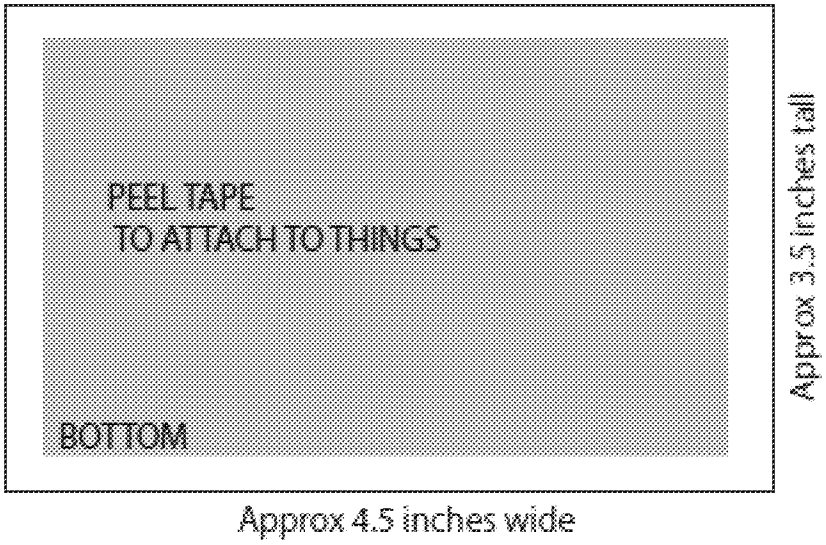
FIG. 8 shows a view of a postcard embodiment with a removable tab for activating a practical joke feature.

FIGS. 7 and 8 show a postcard embodiment with a removable tab for activating a practical joke feature. The postcard can include a top layer with a space for printing or writing a message or indicia, addressee information, and sender information. The top layer can show the location of a user interface element (such as, for example, a button) that can operate in a manner similar to the user interface element described in the greeting card embodiment. The card can include a mode of operation switch (such as, for example, a pull tab) that can operate in a manner similar to the mode of operation switch described in the greeting card embodiment. The card can include a bottom layer with an adhesive layer disposed between the bottom layer of the card and a protective layer. When the protective layer is removed, the card can be fastened to another surface by pressing the adhesive layer against the other surface. The card can include any combination of some or all of the internal components described with respect to the greeting card embodiment, including a pouch, a speaker, a controller, and/or a power source. The internal components can be disposed between the top layer and the bottom layer of the card.

In some embodiments, the postcard includes a controller plays a pre-recorded sound at intervals after the mode of operation switch is activated. For example, the controller can be configured to play a 2-3 second looping chirp every 90 seconds until the battery dies. In certain embodiments, there is a delay between activating the mode of operation switch and initiating playing the pre-recorded sound at intervals. For example, the controller may wait greater than or equal to 1 minute, 90 seconds, 2 minutes, 5 minutes, less than or equal to 10 minutes, less than or equal to 1 hour, a user-selected amount of time, or a period of time between any of the preceding values before initiating playing the pre-recorded sound at intervals. This provides an opportunity for a user of the postcard to leave the area after the card is attached to the bottom of a table, the bottom of a chair, etc., thus providing the user an opportunity to escape and increasing the practical joke value of the postcard. In certain embodiments, the postcard is sized to be difficult to tear and/or destroy. For example, the maximum dimension of the postcard can be less than or equal to about 4.5 inches. The thickness of the postcard can be less than or equal to about 0.25 inches. The thickness of the postcard can taper towards the periphery of the card.

Figure 9:
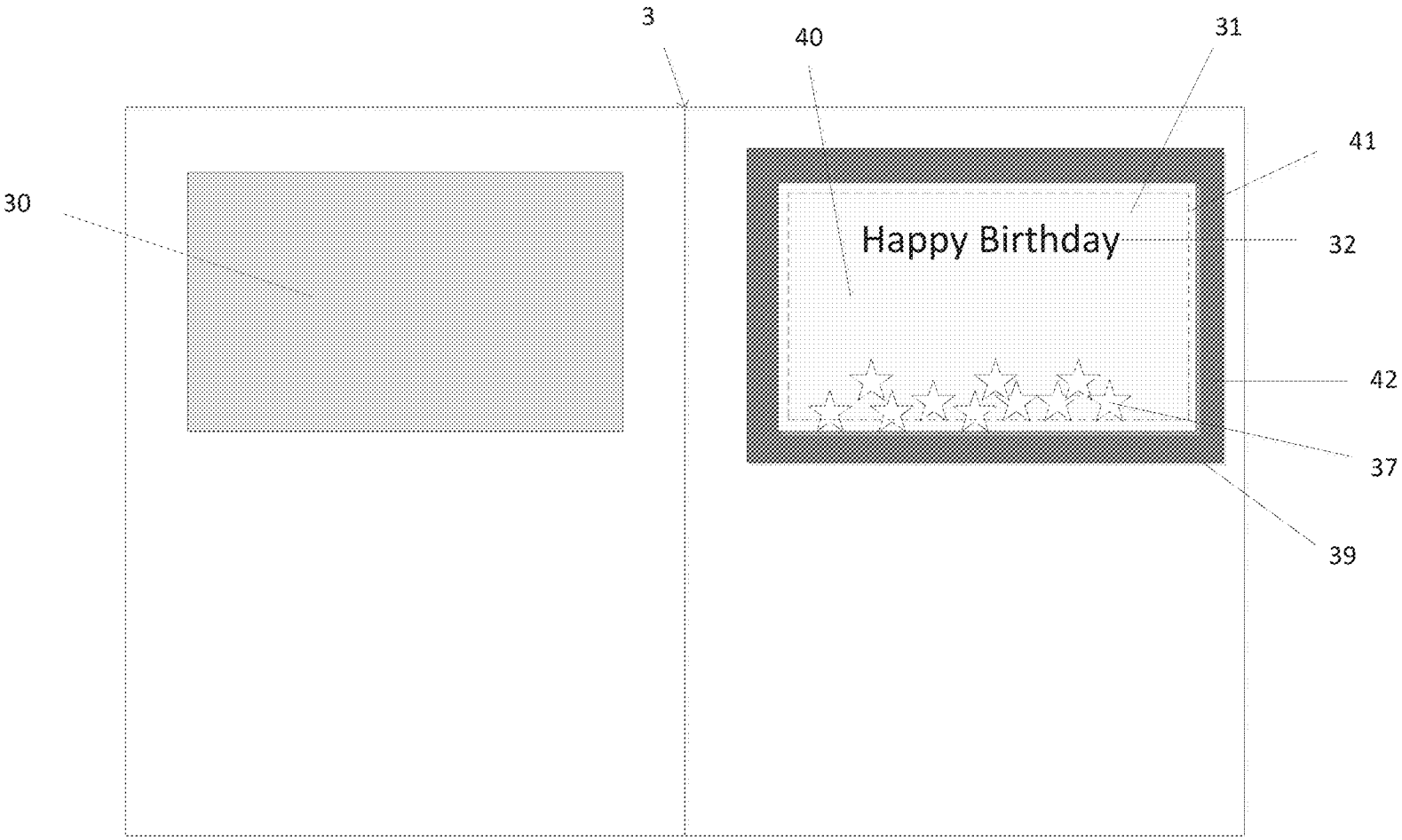
FIG. 9 shows a view of an unfolded greeting card embodiment having two panels and containing a pouch that contains one or more surprises for a card recipient.
Figure 10:
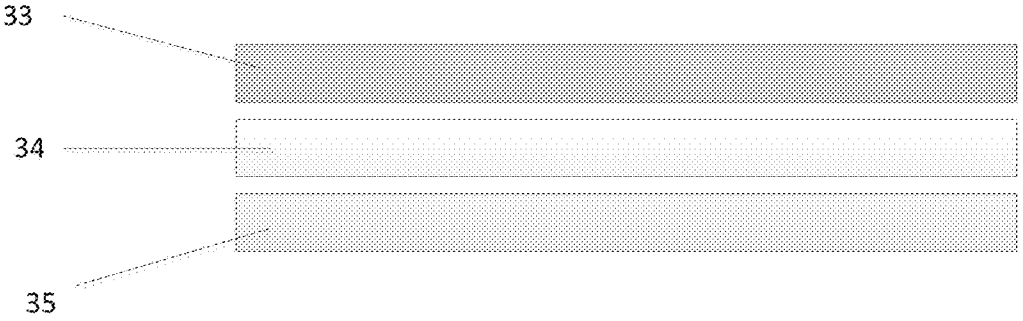
FIG. 10 shows a side view of a first panel of the embodiment of FIG. 9.
Figure 11:
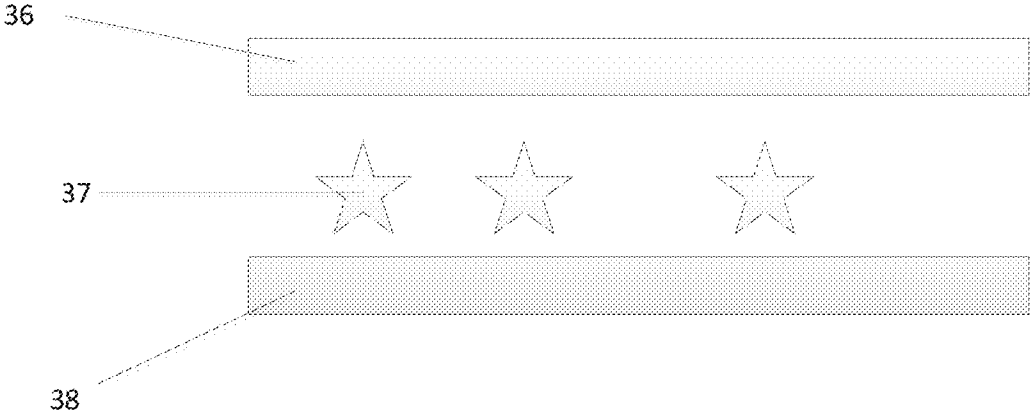
FIG. 11 shows a side view of a second panel of the embodiment of FIG. 9.

FIGS. 9-11 show views of a greeting card embodiment having two panels. As is shown in FIG. 9, the greeting card can include a pouch 31 for holding items inside of the card that can be revealed when the greeting card is opened. The pouch 31 can be attached to the card using any suitable technique. For example, at least a periphery 39 of the pouch 31 can be glued, taped, or otherwise attached to a panel of the card. The pouch 31 can also be fastened to at least one panel of the card using matched tabs and slots, hook-and-loop fasteners, rivets, other fasteners, or a combination of any two or more fasteners. In this way, the pouch 31 can be connected to a panel of the greeting card, such that when the panel of the greeting card is moved, all portions of the pouch will correspondingly move along with the panel of the greeting card, unless acted upon by another force.

The panels of the greeting card may be made of card stock paper or any other material capable of being printed upon. When card stock paper is used, it is preferable to use card stock paper weighing at least 200 grams per square meter. Paper weighing greater than or equal to 300 grams per square meter may. Paper weighing greater than or equal to 350 grams per square meter may also be used. Paper weighing less than or equal to 800 grams per square meter may be used.

In some embodiments, the card includes an adhesive element 30 on at least one panel of the card. As is shown in FIG. 10, this adhesive element 30 can include an adhesive portion 34 comprising an adhesive substance that is disposed between a first panel of the card 35 and a protective layer 33. The adhesive portion 34 can take the form of an adhesive pad or strip. When the protective layer 33 is removed, the adhesive portion 34 can be adhered to an outer surface of the pouch 31. In some embodiments, the adhesive element 30 is initially affixed to a first panel of the card and the pouch 31 is initially affixed to a second panel of the card. With the protective layer 33 of the adhesive element 30 removed, the adhesive portion 34 can be adhered to an outer surface of the pouch 31 by closing the card. When the card is subsequently opened by a recipient, the adhesive portion 34 which is adhered to the pouch 31 causes the pouch to rip, thereby allowing the contents of the pouch 31 to spill out. The pouch 31 can include one or more separable or separating regions configured to easily and predictably produce a separation or split or tear or divide or rupture in the pouch when the greeting card is opened by a receiver of the greeting card. For example, the one or more separable or separating regions can be one or more perforations or one or more break-away portions. For example, as is shown in FIG. 9, the pouch can comprise a first portion 42 of the pouch that is firmly secured to a panel of the greeting card by any suitable means, including glue, tape, or an adhesive band. A perforated portion 41 having perforations can be disposed inside the first portion to allow for easy breaking open of the pouch. The perforated portion is configured to permit a receiver of the card to open the card without realizing the practical joke feature of the card. The perforated region permits the recipient to unfold the greeting card without initially realizing that the adhesive portion 34 has been adhered to at least a portion of the pouch.

The perforated portion 41 defines a closed shape, such as a square, circle, triangle, rectangle, star, or other shape. At least part of the perforated portion 41 actually contains perforations. Typically, the perforations of the perforated portion 41 will comprise greater than 30 percent of the space contained within the perforated portion. Optionally, the perforations can comprise greater than 50 percent of the space of the perforated portion. The perforations can comprise less than 80 percent of the space of the perforated portion. A second portion 40 of the pouch can be disposed inside the perforated portion 41. A sub-portion of the perforated portion 41 that actually contains perforations can optionally form a closed shape, such as a circle, square, triangle, or rectangle or a shape that is not a closed figure, such as, for example, a U-shape. The second portion 40 of the pouch can be configured and spaced to adhere to at least a portion of the adhesive element 30 when the greeting card is folded by a sender of the greeting card and the protective layer 33 is removed.

In some embodiments, the pouch 31 and the adhesive element 30 are spaced relative to each other such that when the greeting card is closed, the adhesive element 30 contacts the pouch 31. In some embodiments, the adhesive element will contact only the second portion 40 of the pouch 31. This is so that when the protective layer 33 is removed, the adhesive substance will adhere only to the second portion of the pouch, making the card easy for the recipient to open without realizing the practical joke feature of the gift card. In other embodiments, the adhesive element can adhere to only an insubstantial portion of the first portion 42 of the pouch 31 when the card is folded, wherein an insubstantial portion is a portion that is small enough that the receiver of the gift card will not be made aware of the practical joke feature of the card when opening the card.

In some embodiments, the pouch 31 can be ripped open to reveal a message printed on the second panel that was originally at least partially obscured by the pouch 31. For this purpose, the pouch material can be at least partially opaque. The outer surface of the pouch 31 can be at least partially constructed from any suitable material capable of being easily torn when the card is opened. For example, the pouch can be at least partially made of paper weighing between 5-75 grams per square meter, paper weighing between 10-20 grams per square meter, or another material that breaks easily when the card is opened up. The pouch may be made of paper that is single ply or multi-ply. The panels of the card are preferably made of a material that is more rigid and durable than the easily torn material of the pouch 31.

The pouch 31 can be filled with a payload comprising any number of objects 37, such as glitter, confetti, small metal or plastic objects, candy, ribbons, small toys, temporary tattoos, papers with printed messages, etc., or any combination of such objects. The pouch 31 can hold a substantial quantity of such objects in order to increase the surprise experienced by the recipient of the card when the pouch is torn open and the contents of the pouch 31 are spilled out. In some embodiments, the pouch can hold only a small quantity of objects 37 in order to minimize the thickness of the card and to minimize suspicion on the part of the recipient.

As is shown in FIG. 11, the pouch 31 can be formed by adhering a top layer 36 of paper or similar material to the second panel 38 of the card. The single sheet of paper 36 is glued, taped, or otherwise attached to the second panel 38 of the card around at least a periphery of the pouch 39 such that the objects 37 are held between the sheet of paper 36 and the second panel 38 of the card before the pouch 31 is torn. Alternatively, the pouch 31 can comprise a bag made of paper or similar material that can hold objects 37 inside. Such a bag can be glued or otherwise attached to the second panel 38 using any suitable technique.

The card can include a fold line 3 that permits the pouch 31 to be hidden from view when the card is folded. The fold line 3 can be disposed at or near a midpoint between the outer left periphery and outer right periphery of the card.

In general, the word "controller," as used herein, refers to logic embodied in hardware or firmware, or to a collection of software instructions, possibly having entry and exit points, written in a programming language, such as, for example, Java, C or C++. A software controller may be compiled and linked into an executable program, installed in a dynamic link library, or may be written in an interpreted programming language such as, for example, BASIC, Perl, or Python. It will be appreciated that controllers can include software modules that may be callable from other modules or from themselves, and/or may be invoked in response to detected events or interrupts. Software instructions may be embedded in firmware, such as an EPROM. It will be further appreciated that hardware controllers may be comprised of connected logic units, such as gates and flip-flops, and/or may be comprised of programmable units, such as programmable gate arrays or processors. The controllers described herein may be represented in software, hardware, or firmware. Generally, the controllers described herein can include logical modules that may be combined with other modules or divided into sub-modules despite their physical organization or storage.

The various illustrative logical blocks, controllers, data structures, and processes described herein may be implemented as electronic hardware, computer software, or combinations of both. To clearly illustrate this interchangeability of hardware and software, various illustrative components, blocks, modules, and states have been described above generally in terms of their functionality. However, while the various modules are illustrated separately, they may share some or all of the same underlying logic or code. Certain of the logical blocks, controllers, and processes described herein may instead be implemented monolithically.

The various illustrative logical blocks, modules, data structures, and processes described herein may be implemented or performed by a machine, such as a computer, a processor, a digital signal processor (DSP), an application specific integrated circuit (ASIC), a filed programmable gate array (FPGA) or other programmable logic device, discrete gate or transistor logic, discrete hardware components, or any combination thereof designed to perform the functions described herein. A processor may be a microprocessor, a controller, a microcontroller, a state machine, combinations of the same, or the like.

Depending on the embodiment, certain acts, events, or functions of any of the processes or algorithms described herein can be performed in a different sequence, may be added, merged, or left out altogether. Thus, in certain embodiments, not all described acts or events are necessary for the practice of the processes. Moreover, in certain embodiments, acts or events may be performed concurrently, e.g., through multi-threaded processing, interrupt processing, or via multiple processors or processor cores, rather than sequentially.

It should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Moreover, any components, features, or steps illustrated and/or described in a particular embodiment herein can be applied to or used with any other embodiment(s). Thus, it is intended that the scope of the inventions herein disclosed should not be limited by the particular embodiments described above.

What is claimed is:

1. A greeting card configured to reveal a hidden payload in response to the greeting card being ripped or destroyed, the greeting card comprising:

a first card panel comprising a first inner surface;

a second card panel comprising a second inner surface;

a third card panel;

a fold line disposed between the first panel and the second panel;

a second fold line disposed between the second panel and the third panel;

a fastener configured to fasten the first inner surface to the second inner surface when the greeting card is folded along the fold line in a fastened configuration; and an internal components region disposed between the first inner surface of the first panel and the second inner surface of the second panel in the fastened configuration;

wherein the internal components region of the greeting card contains a plurality of internal components comprising:

a speaker;

a controller connected to the speaker, wherein the controller implements a safe mode of operation and a recipient mode of operation, and wherein, in the safe mode of operation, the controller is configured to play one loop of a pre-recorded sound through the speaker;

a battery configured to provide electric power to the controller, wherein, in the recipient mode of operation, the controller is configured to continuously play the pre-recorded sound in a loop until the battery is discharged;

a mode of operation switch operatively connected to the controller, wherein, in response to a user operating the mode of operation switch, the controller is configured to switch from the safe mode of operation to the recipient mode of operation; and a pouch comprising a payload configured to be revealed in response to the greeting card being ripped or otherwise destroyed, the payload disposed between the first inner surface of the first card panel and the second inner surface of the second card panel in the fastened configuration.

2. The greeting card of claim 1, wherein the pouch is at least partially made of paper.

3. The greeting card of claim 2, wherein the paper weighs between 5 and 75 grams per square meter.

4. The greeting card of claim 3, wherein the paper weighs between 10 and 20 grams per square meter.

5. The greeting card of claim 1, wherein the payload comprises confetti.

6. The greeting card of claim 1, wherein at least one of the first and second panels is made of card stock having a paper weight of 300-450 grams per square meter.

7. The greeting card of claim 1, wherein the pouch is adhered to at least one of the first inner surface or the second inner surface of the greeting card.

8. The greeting card of claim 1, wherein the fold line permits the internal components of the greeting card to be hidden from view when the greeting card is folded along the fold line.

9. The greeting card of claim 1, wherein the fastener comprises adhesive.

10. The greeting card of claim 1, wherein the mode of operation switch comprises a tab configured to be removed by a sender of the greeting card.

11. The greeting card of claim 10, wherein the tab is connected to a circuit that activates the recipient mode of operation when the circuit is closed by removal of the tab.

12. The greeting card of claim 11, wherein the tab is attached to an electrical insulator that separates leads in the circuit.

13. The greeting card of claim 10, wherein the tab is configured to be removed in response to the sender of the greeting card pulling the tab outward.

14. The greeting card of claim 1, wherein, after the user operates the mode of operation switch, the mode of operation switch cannot be switched from the recipient mode of operation to the safe mode of operation.

15. A card configured to reveal a hidden payload in response to the card being ripped or destroyed, the card comprising:

a first card panel comprising a first inner surface;

a second card panel comprising a second inner surface;

a fold line disposed between the first panel and the second panel;

a fastener configured to fasten the first inner surface to the second inner surface when the card is folded along the fold line; and an internal components region disposed between the first inner surface of the first panel and the second inner surface of the second panel;

wherein the internal components region of the card contains a plurality of internal components comprising:

a speaker;

a controller connected to the speaker, wherein the controller implements a safe mode of operation and a recipient mode of operation, and wherein, in the safe mode of operation, the controller is configured to play one loop of a pre-recorded sound through the speaker;

a battery configured to provide electric power to the controller, wherein, in the recipient mode of operation, the controller is configured to continuously play the pre-recorded sound in a loop until the battery is discharged;

a mode of operation switch operatively connected to the controller, wherein, in response to a user operating the mode of operation switch, the controller is configured to switch from the safe mode of operation to the recipient mode of operation, wherein, after the user operates the mode of operation switch, the mode of operation switch cannot be switched from the recipient mode of operation to the safe mode of operation; and a pouch comprising a payload configured to be revealed in response to the card being ripped or otherwise destroyed.

16. The card of claim 15, wherein the pouch is adhered to at least one of the first inner surface or the second inner surface of the card.

17. The card of claim 15, wherein the fold line permits the internal components of the card to be hidden from view when the card is folded along the fold line.

18. The card of claim 15, wherein the mode of operation switch comprises a tab configured to be removed by a sender of the card, wherein the tab is configured to be removed in response to the sender of the card pulling the tab outward.

19. The card of claim 18, wherein the tab is attached to an electrical insulator that separates leads in the circuit.

20. The card of claim 19, wherein the tab is configured to be removed in response to the sender of the card pulling the tab outward.

21. The card of claim 15, further comprising:

a third card panel comprising a third inner surface; and a second fold line disposed between the second panel and the third panel, wherein the card is disposed in an open configuration when not folded along the second fold line;

wherein the tab is configured to be removable only in the open configuration.

* * * * *